United States Patent [19]

Spercel

[11] Patent Number: 4,625,614

[45] Date of Patent: Dec. 2, 1986

[54] TUNING DEVICE

[76] Inventor: Robert J. Spercel, 3214 E. 139th St., Cleveland, Ohio 44111

[21] Appl. No.: 759,951

[22] Filed: Jul. 29, 1985

[51] Int. Cl.[4] ..... G10D 3/14

[52] U.S. Cl. ..... 84/306; 84/304

[58] Field of Search ..... 84/200–208, 84/304–306

[56] References Cited

U.S. PATENT DOCUMENTS

| | | | |
|---|---|---|---|
| 542,157 | 7/1895 | Gosse | 84/306 |
| 1,443,486 | 1/1923 | Lindstrom | 84/305 |
| 4,213,370 | 7/1980 | Jones | 84/291 |

FOREIGN PATENT DOCUMENTS

| | | | |
|---|---|---|---|
| 22701 | of 1908 | United Kingdom | 84/304 |
| 231064 | 3/1925 | United Kingdom | 84/304 |

*Primary Examiner*—Lawrence R. Franklin

*Attorney, Agent, or Firm*—Yount & Tarolli

[57] ABSTRACT

An improved tuning device for a string of a musical instrument includes a string post having an opening at one end to receive the string. In order to tune the string, a worm and pinion are manually actuated to rotate the string post. In accordance with a feature of the invention, a passage extends axially through the pinion and at least part way through the string post. In one embodiment of the invention, a clamp is provided in the passage to grip the string. In another embodiment of the invention, the string itself is pulled through the passage. In both embodiments of the invention, the string is manually pulled taut before actuating the worm and pinion to rotate the string post and tune the string. This enables the string to be quickly and easily tuned by turning the string post through less than one revolution. Since the string post is turned through less than one revolution, less than one complete turn or coil of the string is wrapped around the string post.

2 Claims, 6 Drawing Figures

TUNING DEVICE

BACKGROUND OF THE INVENTION

The present invention relates to a tuning device for a string of a musical instrument, such as a guitar.

A known tuning device for a string of a musical instrument is disclosed in U.S. Pat. No. 4,353,280. When the string is to be tuned with this device, the string is inserted through a hole or opening in one end of a string post. A knob is then manually turned to rotate a worm which is in meshing engagement with a pinion. The pinion is formed as one piece with the string post. Therefore, rotation of the pinion turns the string post.

The string post of the tuning device disclosed in U.S. Pat. No. 4,353,280 must be turned through several complete revolutions before the string is pulled sufficiently tight to have the desired pitch or tune. Due to the gear ratio between the worm and pinion, many turns of a knob connected with the worm are required in order to turn the string post through just a few revolutions. Therefore, substantial time and effort is required to rotate the worm to effect rotation of the string post through several revolutions to tune a string.

Rotating a string post through several revolutions results in a corresponding number of wraps or coils of the string being formed around the end of the string post. During playing of the musical instrument, these coils can shift relative to each other and change the pitch of the string which was so laboriously tuned. The change in pitch of the tuned string, due to shifting of the coils on a string post, becomes particularly troublesome when a tremolo bridge system is used to vary the pitch of the string.

SUMMARY OF THE PRESENT INVENTION

The present invention provides a tuning device having a string post which is rotated through a short distance to quickly and easily tune a string of a musical instrument to a desired pitch. The tuning device has a passage which extends axially through both a string post and a pinion connected with the string post. In one embodiment of the invention, a clamp assembly is disposed in the passage. The clamp assembly is actuated to firmly grip the string after it has been manually pulled tight. The manual pretightening of the string enables it to be tuned to the desired pitch by rotating the string post through a short distance which may be less than one complete revolution.

In another embodiment of the invention, the string itself extends through the passage in the string post and pinion. The end of the string extends from the pinion and can be manually pulled tight. The pinion and string post are then rotated through a short distance to tighten the manually pretensioned string to have a desired pitch or tune.

Accordingly, it is an object of this invention to provide a new and improved device for tuning a string of a musical instrument and wherein a passage extends axially through a string post and pinion which are rotated to tighten the string.

Another object of this invention is to provide a new and improved tuning device for a string of a musical instrument and wherein a clamp assembly for gripping the string is disposed in a passage extending through the string post and pinion.

Another object of this invention is to provide a new and improved device for tuning a string of a musical instrument and wherein a portion of the string extends through a passage in a string post and pinion.

BRIEF DESCRIPTION OF THE DRAWINGS

The foregoing and other objects and features of the present invention will become more apparent to those skilled in the art upon a consideration of the following description taken in conjunction with the accompanying drawings wherein.

DESCRIPTION OF SPECIFIC PREFERRED EMBODIMENTS OF THE INVENTION

General Description

Figure 1:
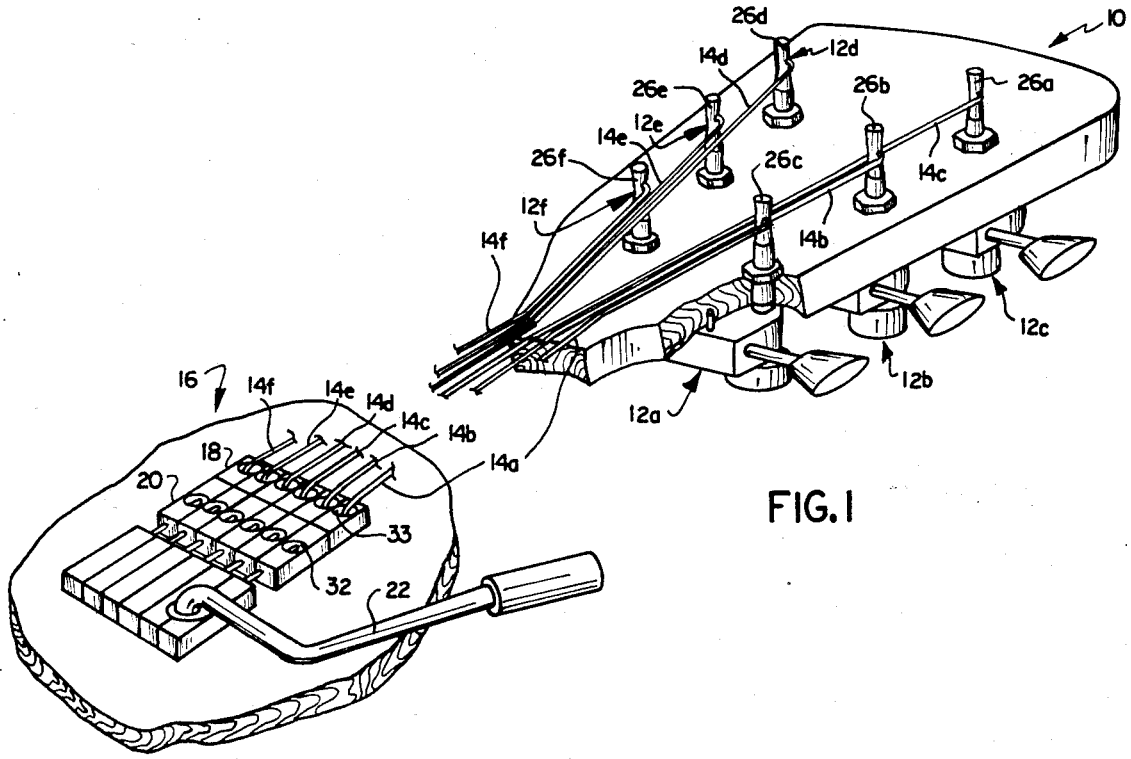
FIG. 1 is a fragmentary pictorial illustration of the head of a stringed musical instrument having a plurality of tuning devices constructed in accordance with one embodiment of the present invention.

The head portion 10 of a stringed musical instrument, such as a guitar, has tuning devices 12*a–f* (FIG. 1) constructed in accordance with one embodiment of the present invention. A plurality of strings 14*a–f* extend from the head of the instrument to a bridge, such as a known tremolo bridge system 16. The tremolo bridge system 16 includes a stationary section 18 and a movable section 20. Upon actuation of a lever 22, the movable section 20 pivots relative to the stationary section 18 to reduce the tension in the strings 14*a–f*. When the tremolo lever 22 is released, the movable section 20 pivots back to retension the strings 14*a–f*.

Prior to playing of the musical instrument, the improved tuning devices 12*a–f* are manually actuated to tension the strings 14*a–f* to have a desired pitch. Actuation of the tuning devices 12*a–f* rotates upstanding cylindrical string posts 26*a–f* to wrap ends of the strings 14*a–f* around the string post. During actuation of the tuning devices 12*a–f* to tune the strings 14*a–f*, the end portions of the strings are wrapped around the string posts 26*a–f* through less than one complete turn or coil.

When the musical instrument is played, the tremolo lever 22 if depressed and released to vary the tension and pitch of the strings 14*a–f* in a known manner. Since less than one turn or coil of each of the strings 14*a–f* is provided around the string posts 26*a–f*, the strings do not shift relative to the string posts during actuation and releasing of the tremolo lever 22. Therefore, the initial tension is re-established in the strings 14*a–f* so that they will have their original pitch upon releasing of the tremolo lever 22.

If the strings 14*a–f* had been wrapped around the string posts 26*a–f* for a relatively large number of turns, there would be a tendency for the coils or turns to shift relative to each other. This would result in a change in the tension of one or more of the strings 14*a–f* and a corresponding loss of tuning of the strings. Although it is preferred to wrap the strings 14*a–f* around the ends of the string posts 26*a–f* for less than one complete turn, the strings could be wrapped around the string posts for slightly more than one turn if desired.

Since the tuning devices 12*a–f* only wrap the strings 14*a–f* part way around the string posts 26*a–f*, the strings can be quickly and easily tuned to a desired pitch with the tuning devices 12*a–f*. Therefore, it is believed that although the improved tuning devices 12*a–f* are advantageously used with the tremolo bridge system 16, the tuning devices will be used in association with musical instruments which do not have a tremolo bridge system.

Tuning a String

When the string 14*a* is to be installed and then tuned with the tuning device 12*a*, one end of the string is fixedly connected with a fastener 32 in the tremolo bridge system 16. The string is then positioned in guides 33 in the tremolo bridge system 16. The free end of the string is then threaded through a cylindrical hole or opening 34 (FIG. 2) in the outer end portion of the string post 26*a*. Thereafter, the free end of the string 14*a* is manually pulled to provide an initial tension in the string.

Once the string 14*a* has been pulled tight, a clamp assembly 40 (FIG. 3) is actuated by rotating a circular knob 42 to clamp the string against movement relative to the string post 26*a*. The initial tension in the string 14*a* is not sufficient to enable the string to have the desired pitch. Therefore, a second knob 44 (FIGS. 2 and 3) is manually turned to rotate a worm 46 disposed in meshing engagement with a pinion 48. The pinion 48 is formed as one piece with the cylindrical string post 26*a*. Therefore, rotation of the pinion 48 results in a corresponding rotation of the string post 26*a*.

As the string post 26*a* is rotated, the string 14*a* is wound around the outer end portion of the string post 26*a*. Since an initial tension was provided in the string 14*a* by manually pulling on the string before the clamp assembly 40 was actuated to grip the string, the coaxial pinion 48 and string post 26*a* have to be rotated through only a small distance in order to tighten the string to have a tension corresponding to a desired pitch. This tension can usually be obtained when the string post 26*a* has been rotated through less than one turn. Therefore, there is only a partial wrap or turn of the string 14*a* around the string post 26*a*.

Tuning Device—Housing

The improved tuning device 12*a* has a one-piece housing 52 with a rectangular main or base section 54 (FIG. 3) which encloses and rotatably supports the worm 46 and pinion 48. The pinion 48 has a cylindrical shoulder or flange 56 which slidably abuts a flat bearing surface 58 inside the base section 54 of the housing 52. The flat bearing surface 58 extends perpendicular to the axis about which the string post 26*a* and pinion 48 rotate.

In addition to the base section 54, the one-piece housing 52 has a cylindrical tubular section 62 which is coaxial with the pinion 48 and string post 26*a*. The tubular section 62 has a cylindrical inner side surface which supportingly engages a cylindrical outer side surface of the string post 26*a*. The tubular section 62 of the housing 52 has been plastically deformed radially inwardly to engage an annular groove 64 in the string post 26*a* to hold the string post against both axial and sidewise movement. The construction of the housing 52 and the manner in which it supports the worm 46, pinion 48 and string post 26*a* is the same as is disclosed in U.S. Pat. No. 4,353,280 and will not be further described herein.

Tuning Device—Clamp Assembly

The clamp assembly 40 grips the string 14*a*, after it has been manually tensioned, to enable the string to be quickly and easily tuned with less than one complete turn of the coaxial pinion 48 and string post 26*a*. Therefore, the number of turns of the knob 44 and worm 46 required to tune the string 14*a* tends to be minimized. This minimizes the time and effort required to tune the string 14*a*. In addition, since the string 14*a* is wrapped around the string post 26*a* for less than one complete turn, the string does not have a plurality of coils or turns which can shift relative to each other during playing of an instrument with the resulting loss of tuning of the string.

Figure 4:
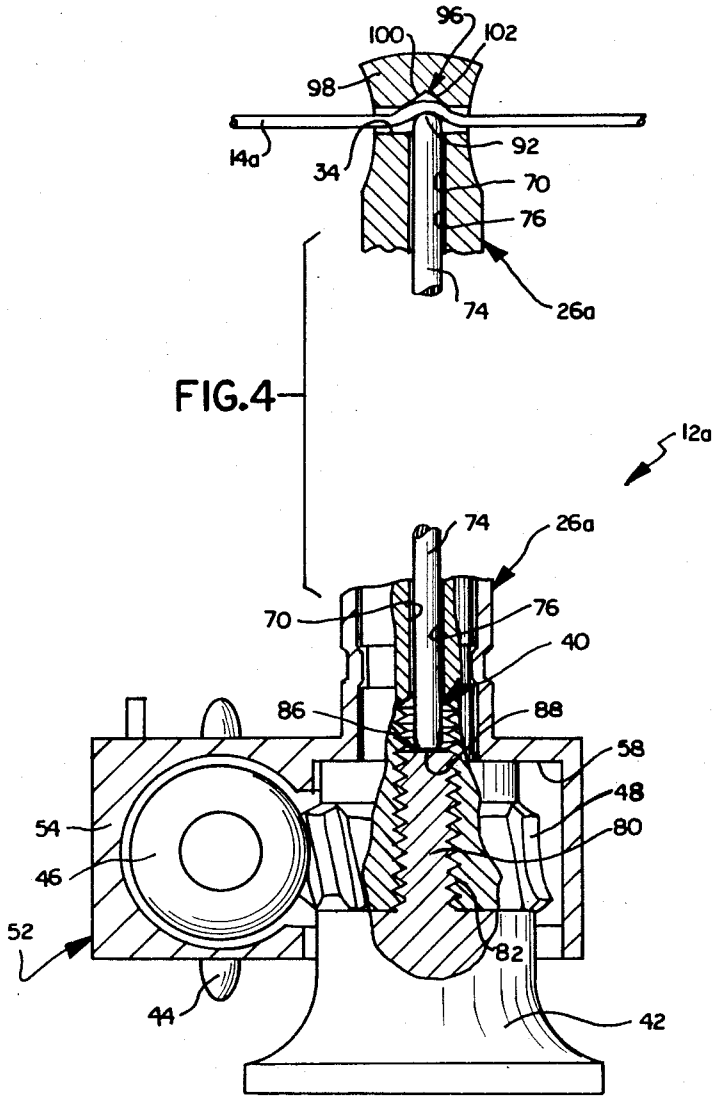
FIG. 4 is an enlarged fragmentary sectional view illustrating the manner in which the clamp assembly of FIG. 3 grips a string.

In accordance with one of the features of the present invention, the clamp assembly 40 is disposed in a cylindrical passage 70 which extends axially through the string post 26*a* and the pinion 48 (FIG. 4). This enables the knob 42, which actuates the clamp assembly 40, to be located adjacent to the knob 44 which rotates the worm 46. The clamp assembly knob 42 and the worm knob 44 are both disposed on the same side of the head 10 of the musical instrument (see FIG. 1). Therefore, the clamp assembly knob 42 and worm knob 44 can be readily actuated with one hand without changing the orientation of the instrument.

The clamp assembly 40 includes a cylindrical pin 74. The pin 74 has an outer side surface which slidably engages a smooth cylindrical side surface 76 (FIG. 4) of the portion of the passage 70 which extends through the string post 26*a*. In addition, the clamp assembly 40 includes an externally threaded stud 80. The stud 80 is fixedly connected with the knob 42. The stud 80 engages an internal thread convolution 82 formed in an end portion of the passage 70 which extends through the pinion 48 and into the string post 26*a*.

Rotation of the knob 42 causes the stud 80 to rotate and move axially in the passage 70. When the knob 42 is rotated in one direction, the external threads on the stud 80 cooperate with the internal thread convolution 82 to press a circular end surface 86 of the stud against a circular end surface 88 on the pin 74. This moves the pin 74 in the passage 70 to increase the pressure applied against the string 14*a*.

The stud 80 is formed separately from the pin 74. Therefore, rotation of the stud 80 does not rotate the pin 74. If the pin 74 was integrally formed with the stud 80, the outer end 92 of the pin 74 would rotate relative to the string 14*a* and tend to cut or scrape the string. Although it is preferred to form the pin 74 separately from the stud 80, the stud and pin could be formed as one piece. This would be done if rotation of the end 92 of the pin 74 relative to the string 14*a* was not objectionable or if a nonrotating force transmitting member was provided between the end of the pin and the string.

In order to provide a firm gripping action between the pin 74 and the string 14*a*, the outer end portion 92 of the pin presses the string into a recess 96 formed in an outer end portion 98 of the string post 26*a*. The outer end portion 92 of the pin 74 is shaped to have a configuration corresponding to the shape of side surface areas 100 and 102 of the recess 96. This results in the pin 74 firmly clamping the string 14*a* against both of the side surface areas 100 and 102 when the knob 42 is rotated to apply an axial compression force against the pin 74.

In one specific instance, the recess 96 had a conical configuration corresponding to the conical configuration of the tip of a drill which was used to partially form the axial passage 70 which extends through the string post 26*a* and pinion 48. The outer end portion 92 of the pin 74 was shaped to have a conical surface with the same included angle as the recess 96.

Figure 2:
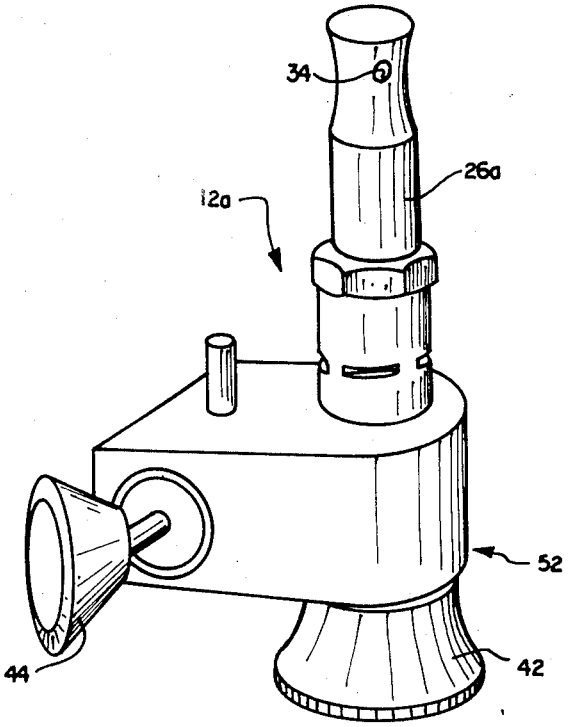
FIG. 2 is an enlarged pictorial view of one of the tuning devices shown in FIG. 1.
Figure 3:
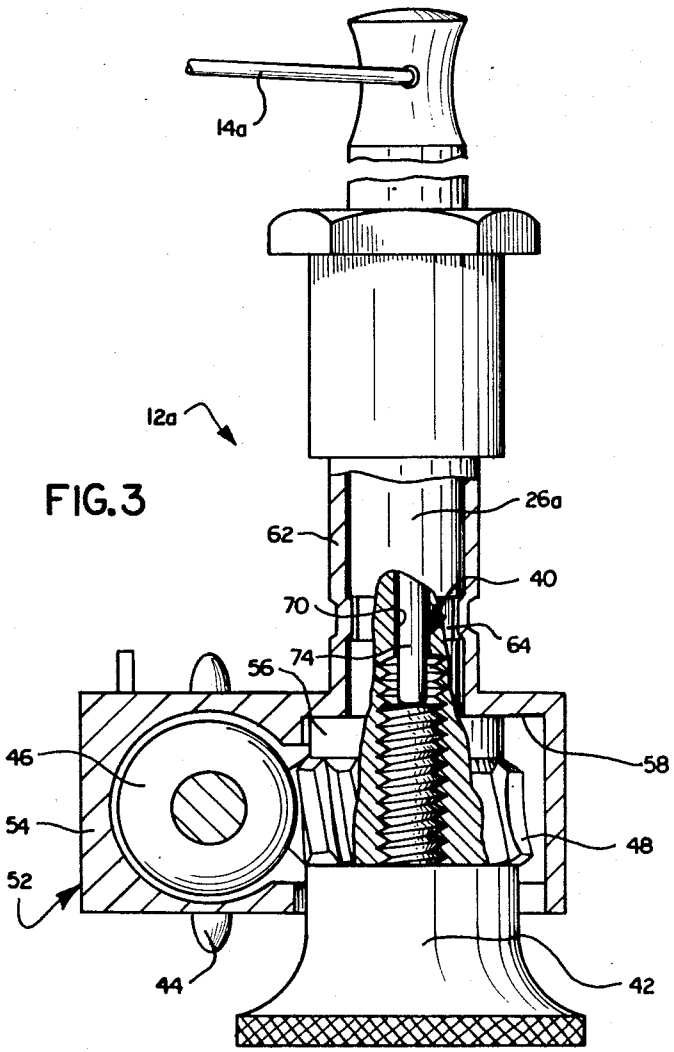
FIG. 3 is an enlarged sectional view illustrating the relationship between a string clamp assembly, pinion, and string post of the tuning device of FIG. 2.

Although the construction of only the tuning device 12*a* is shown in FIGS. 2–4, it should be understood that the tuning devices 12*b–f* have the same construction and mode of operation as the tuning device 12*a*.

Second Embodiment of the Invention

In the embodiment of the invention shown in FIGS. 1–4, the clamp assembly 40 is disposed in the passage 70 which extends through the string post 26*a* and pinion 48. However, in the embodiment of the invention shown in FIGS. 5 and 6, the clamp assembly is eliminated and the string itself extends through a passage in the string post and pinion. Since the embodiment of the invention shown in FIGS. 5 and 6 is generally similar to the embodiment of the invention shown in FIGS. 2–4, similar numerals will be utilized to designate similar components, the suffix letter "g" being associated with the embodiment of the invention shown in FIGS. 4 and 5 in order to avoid confusion.

Figure 6:
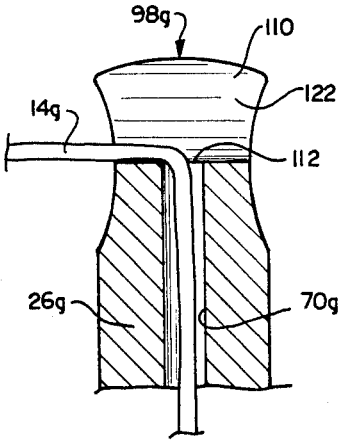
FIG. 6 is a sectional view, taken along the lines 6—6 of FIG. 5, illustrating the manner in which the string enters the passage through the string post and pinion.
Figure 5:
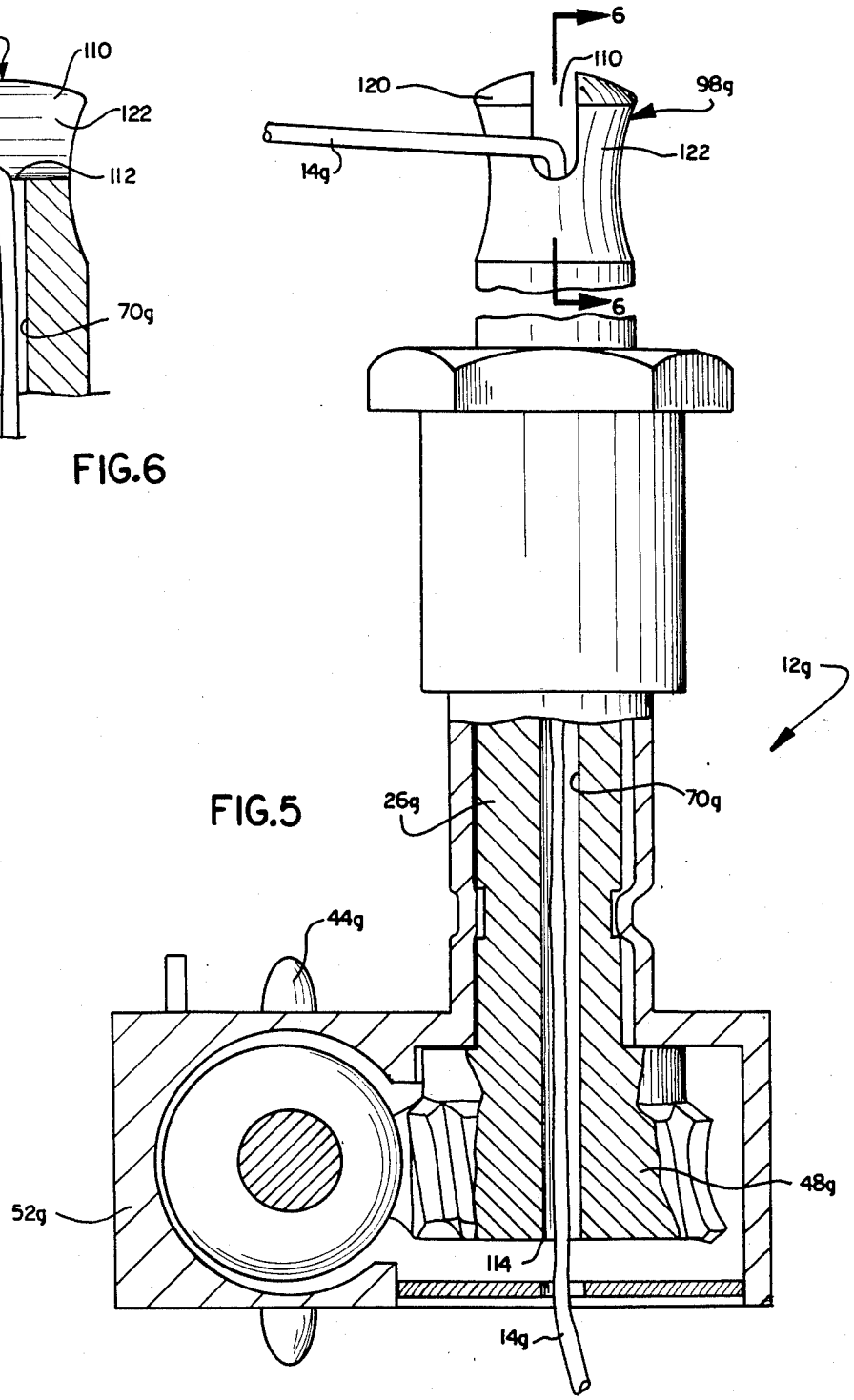
FIG. 5 is a sectional view, generally similar to FIG. 3, of another embodiment of the tuning device in which a string receiving passage extends axially through the string post and pinion.

In the embodiment of the invention shown in FIGS. 5 and 6, a guitar string 14*g* extends into a passage 70*g* which extends through the string post 26*g* and a pinion 48*g*. The string post 26*g* and pinion 48*g* are formed as one piece. The cylindrical passage 70*g* is disposed in a coaxial relationship with the pinion 48*g* and the string post 26*g*.

When the guitar string 14*g* is to be tightened, it is threaded through a slot 110 in an upper end portion 98*g* of the string post 26*g*. The free end of the string 14*g* is then guided through a circular entrance 112 (FIG. 6) to the passage 70*g*. The string is pushed through the passage 70*g* and a circular opening 114 (FIG. 5) at the end of the worm gear 48*g*.

After the string 14*g* has been manually pulled taut to provide an initial tension in the string, a knob 44*g* is rotated to rotate a worm 46*g*. Rotation of the worm 46*g* rotates the pinion 48*g* and string post 46*g* about their common axis. Since the string 14*g* extends into the slot 110 and is bent as shown in FIG. 6, rotation of the string post 26*g* wraps the string around the outer end portion of the string post.

The string 14*g* is manually pretensioned by pulling on the free end of the string. Therefore, the string can usually be tightened to have a tension corresponding to the desired pitch by rotating the string post 26*g* through less than one revolution.

Although the string 14*g* may extend directly into the open ended slot 110 and the passage 70*g* in the manner shown in FIGS. 5 and 6, the string could be semi-wrapped or cross-hitched around the upper end portion 98*g* of the string post 26*g* before or after the string enters the passage 70*g*. Thus, the string could be pulled taut and manually wrapped tightly around a section 120 or 122 of the string post 26*g*. Once the string 14*g* has been hitched around the section 120 or 122 of the string post 26*g*, the string is guided into the passage 70*g* in the manner shown in FIG. 6.

Conclusion

In view of the foregoing description, it is apparent that the present invention provides a tuning device 12*a* or 12*g* having a string post 26*a* or 26*g* which is rotated through a short distance to quickly and easily tune a string 14*a* or 14*g* of a musical instrument to a desired pitch. The tuning device 12*a* or 12*g* has a passage 70 or 70*g* which extends axially through both the string post 26*a* or 26*g* and the pinion 48 or 48*g* connected with the string post. In one embodiment of the invention (FIGS. 1–4), a clamp assembly 40 is disposed in the passage 70. The clamp assembly 40 is actuated to firmly grip the string 14*a* after it has been manually pulled tight. The manual pretightening of the string 14*a* enables it to be tuned to the desired pitch by rotating the string post 26*a* through a short distance which may be less than one complete revolution.

In another embodiment of the invention (FIGS. 5 and 6), the string 14*g* itself extends through the passage 70*g* in the string post 26*g* and pinion 48*g*. Thus, the loose end of the string extends from the pinion 48*g* and can be manually pulled tight. The pinion 48*g* and string post 26*g* are then rotated through a short distance to tighten the manually pretensioned string 14*g* to have a desired pitch or tune.

Although it is preferred to manually pull the string 14*a* or 14*g* to have an initial tension so that only a partial turn of the string post 26*a* or 26*g* is necessary to tune the string, it is contemplated that in certain circumstances it may be necessary to rotate the string post through more than one revolution to tighten the string. Although the tuning devices 12*a* or 12*g* are advantageously used with a tremolo bridge system 16, it should be understood that the present invention is not to be limited to use with any particular type of musical instrument or bridge system.

Having described a specific preferred embodiment of the invention, the following is claimed:

1. A device for tuning a string of a musical instrument, said device comprising a housing, a string post having a first end portion projecting from said housing and a second end portion disposed in said housing, a pinion connected to said second end portion of said string post and disposed in said housing, a worm disposed in said housing in meshing engagement with said pinion, first manually rotatable knob means connected with said worm and disposed at least partially outside of said housing for rotating said worm to thereby impart rotary motion to said pinion and string post, said string post including first surface means for defining a string passage which extends through the first end portion of said string post in a direction transverse to a central axis of the string post to receive a portion of the string, said string post including second surface means for defining a second passage which extends axially through said string post and pinion from an intersection with said first passage to an opening in the second end portion of said string post, said second passage including an internally threaded portion circumscribed by said pinion, a clamp pin disposed in said second passage and having a cylindrical outer side surface disposed in engagement with said second surface means, said clamp pin having a first end surface means for engaging the string at the intersection of said string passage and second passage and a second end surface means disposed in said second passage adjacent to said pinion, externally threaded means disposed in threaded engagement with said internally threaded portion of said second passage, said externally threaded means being disposed in abutting engagement with said second end surface means on said clamp pin, and second manually rotatable knob means connected with said externally threaded means and disposed at least partially outside of said housing for rotating said externally threaded means relative to said string post to clamp the string against said first surface means at the intersection of said string passage and said second passage under the influence of forces transmitted from said externally threaded means through said clamp pin to the string.

2. A device as set forth in claim 1 wherein said first surface means includes means for defining an indentation into which the string is pressed by said clamp pin upon rotation of said second knob means.

* * * * *